US007980869B1

(12) United States Patent
Huang

(10) Patent No.: US 7,980,869 B1
(45) Date of Patent: Jul. 19, 2011

(54) SAFETY SOCKET

(75) Inventor: Jing-Xiao Huang, Taipei (TW)

(73) Assignee: Well Shin Technology Co., Ltd., Taipei (TW)

( * ) Notice: Subject to any disclaimer, the term of this patent is extended or adjusted under 35 U.S.C. 154(b) by 0 days.

(21) Appl. No.: 12/913,069

(22) Filed: Oct. 27, 2010

(51) Int. Cl.
*H01R 13/44* (2006.01)

(52) U.S. Cl. ..... 439/139; 439/137

(58) Field of Classification Search ..... 439/135–145, 439/652, 654
See application file for complete search history.

(56) References Cited

U.S. PATENT DOCUMENTS 5,096,432 A * 3/1992 Cullen et al. ..... 439/139
5,695,350 A * 12/1997 Mei ..... 439/139
5,746,612 A * 5/1998 Chien-Yuan ..... 439/139
6,537,089 B1 * 3/2003 Montague ..... 439/145
7,637,756 B1 * 12/2009 Hsu ..... 439/145

* cited by examiner

*Primary Examiner* — Thanh-Tam T Le
(74) *Attorney, Agent, or Firm* — WPAT, P.C.; Anthony King

(57) ABSTRACT

A safety socket for receiving terminals of a plug includes a socket housing where at least two electrodes are mounted, a socket cover coupled with the socket housing and defining at least two inserting apertures corresponding to the electrodes, and an insulating baffle rotatably located above the electrodes by a torsional spring and having at least two gaps opened at intervals along a circle of which a center is at the rotation axis of the insulating baffle, and at least two driven slopes arranged alternately with the gaps along the circle. The driven slopes movably block between the inserting apertures and the corresponding electrodes. The terminals pass through the inserting apertures and act on the driven slopes to drive the insulating baffle to rotate so as to make the gaps exposed in alignment with the corresponding electrodes. Then the terminals pass through the gaps to be inserted in the electrodes.

8 Claims, 6 Drawing Sheets

SAFETY SOCKET

BACKGROUND OF THE INVENTION

1. Field of the Invention

The present invention generally relates to a socket, and more particularly to a safety socket capable of preventing electric shock.

2. The Related Art

Electronic products have developed rapidly over the past few decades. With more sockets utilized than before, the safety structure is apparently important for the socket. Generally, an inserting aperture of the socket has an electrode made of copper sheet for electrically connecting with a plug. Such socket can be electrically connected with the plug when a terminal of the plug is not fully inserted into the inserting aperture of the socket. As a result, when a user contacts the terminal during insertion or extraction of the plug carelessly, it is easy to cause accidents, for example electric shock. So, there is a need to design a socket which is able to prevent electric shock.

Referring to FIG. 1 and FIG. 2, a safety socket 100' capable of preventing electric shock includes a socket housing 10', at least two electrodes (not labeled), insulating baffles 20' and springs 30' disposed in the socket housing 10' respectively, wherein the number of the insulating baffles 20' and the springs 30' is respectively equal to that of the electrodes. The safety socket 100' has at least two inserting holes 11' and a sliding track 12'. When there is no plug (not shown) inserted into the safety socket 100', the insulating baffles 20' block the inserting holes 11' respectively under the thrust of the corresponding springs 30' for avoiding electric shock. When the plug is inserted into the safety socket 100', terminals of the plug drive the insulating baffles 20' to slide towards a centre of the socket housing 10' along the sliding track 12' by means of the insertion force thereof, so as to make the inserting holes 11' be exposed and then the terminals of the plug be inserted into the inserting holes 11' respectively to form an electrical connection with the corresponding electrodes. The foregoing safety socket 100' utilizes the slide of the insulating baffle 20' to block or set free the inserting hole 11'. However, in use, the terminal of the plug acts on one end of the insulating baffle 20' that causes the other end of the insulating baffle 20' tend to perk up and touch a socket cover (not shown). As a result, an unexpected friction occurs between the socket cover and the insulating baffle 20', and even between the socket housing 10' and the insulating baffle 20', which results in a laborious insertion of the plug and easily shortens the use life of the safety socket 100'.

SUMMARY OF THE INVENTION

An object of the present invention is to provide a safety socket adapted for receiving a plug which has at least two terminals. The safety socket includes a socket housing where at least two electrodes are mounted, a socket cover coupled with the socket housing, and an insulating baffle disposed between the socket housing and the socket cover. The socket cover defines at least two inserting apertures corresponding to the electrodes. Each of the inserting apertures is aligned with the corresponding electrode along the insertion direction of the terminals of the plug. The insulating baffle is rotatably located above the electrodes by a torsional spring for operably blocking between the inserting apertures and the electrodes. The insulating baffle has at least two gaps opened at intervals along a circle of which a center is at the rotation axis of the insulating baffle, and at least two driven slopes arranged alternately with the gaps along the circle. Each driven slope is gradually inclined upward from one end thereof adjacent to the corresponding gap to the other end thereof away from the corresponding gap. Wherein the driven slopes movably block between the inserting apertures and the corresponding electrodes, the terminals of the plug pass through the corresponding inserting apertures and act on the driven slopes to drive the insulating baffle to rotate so as to make the gaps exposed in alignment with the corresponding electrodes, then the terminals further pass through the gaps to be inserted in the corresponding electrodes.

As described above, the insulating baffle has the driven slopes and the gaps alternately arranged along the circle of which the center is located at the rotation axis of the insulating baffle. Such structure ensures the insertion force from the terminals of the plug acting on the driven slopes be balanced about the rotation axis of the insulating baffle, so as to avoid the insulating baffle slanting and even getting stuck in the process of the rotation thereof. Therefore, the safety socket not only is convenient for users to operate, but also has a longer use life.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
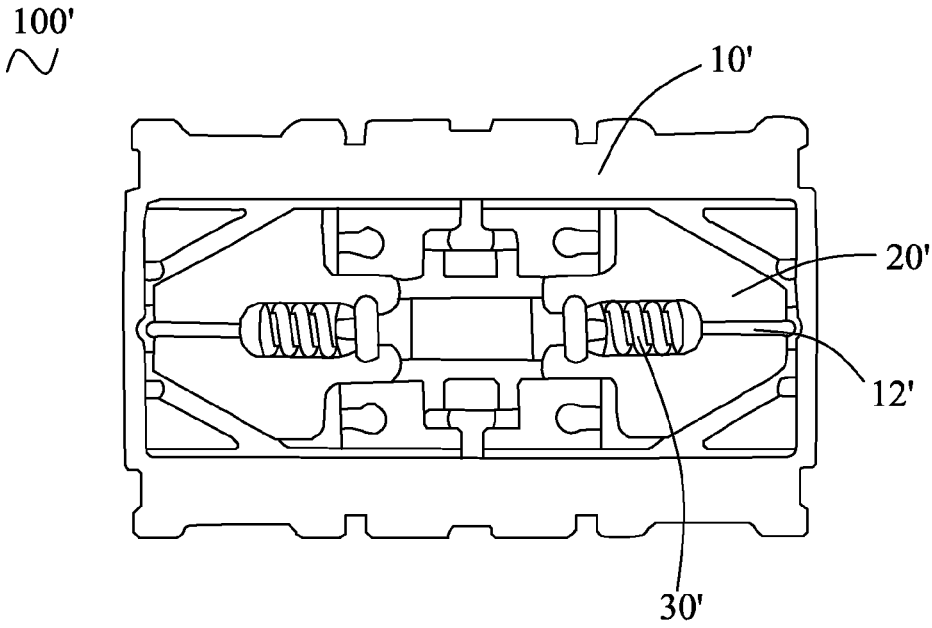
FIG. 1 (Prior Art)
FIG. 1 is a schematic view of a traditional safety socket, wherein there is no plug inserted in the safety socket.
Figure 2:
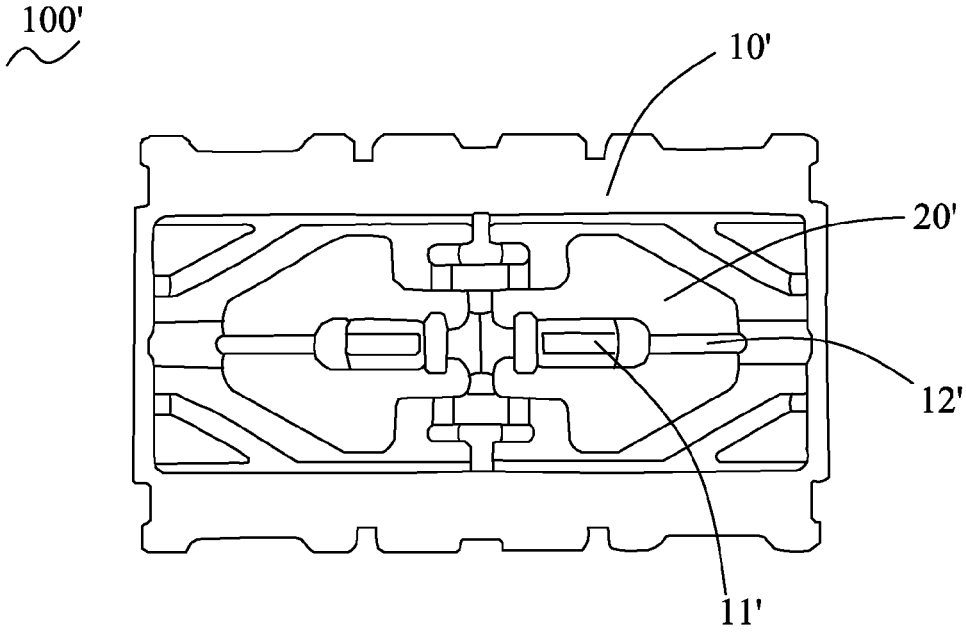
FIG. 2 (Prior Art)
FIG. 2 is another schematic view of the safety socket of FIG. 1, illustrating a usage state of the plug being inserted into the safety socket.
Figure 3:
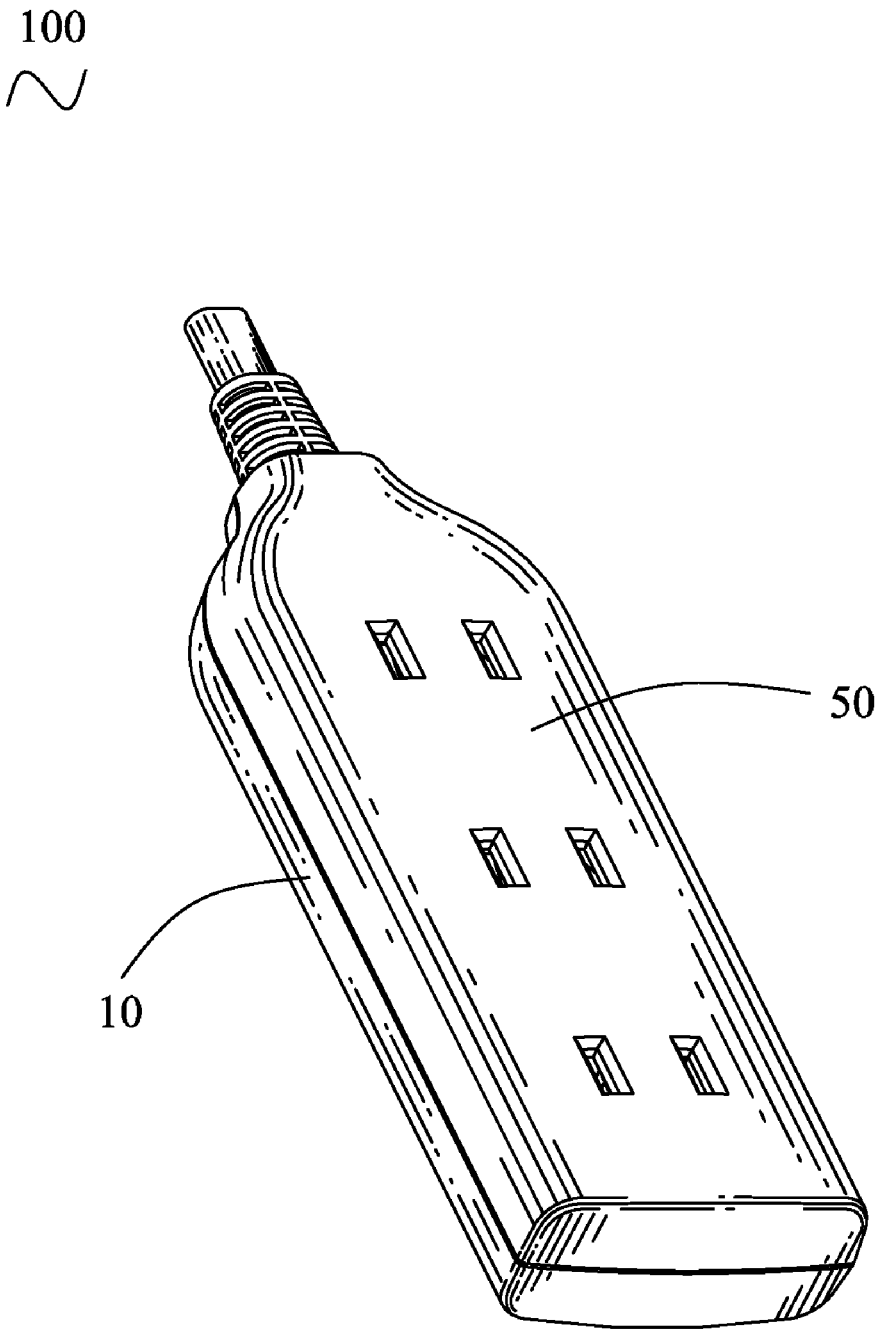
FIG. 3 is an assembled perspective view of a safety socket of an embodiment in accordance with the present invention.
Figure 4:
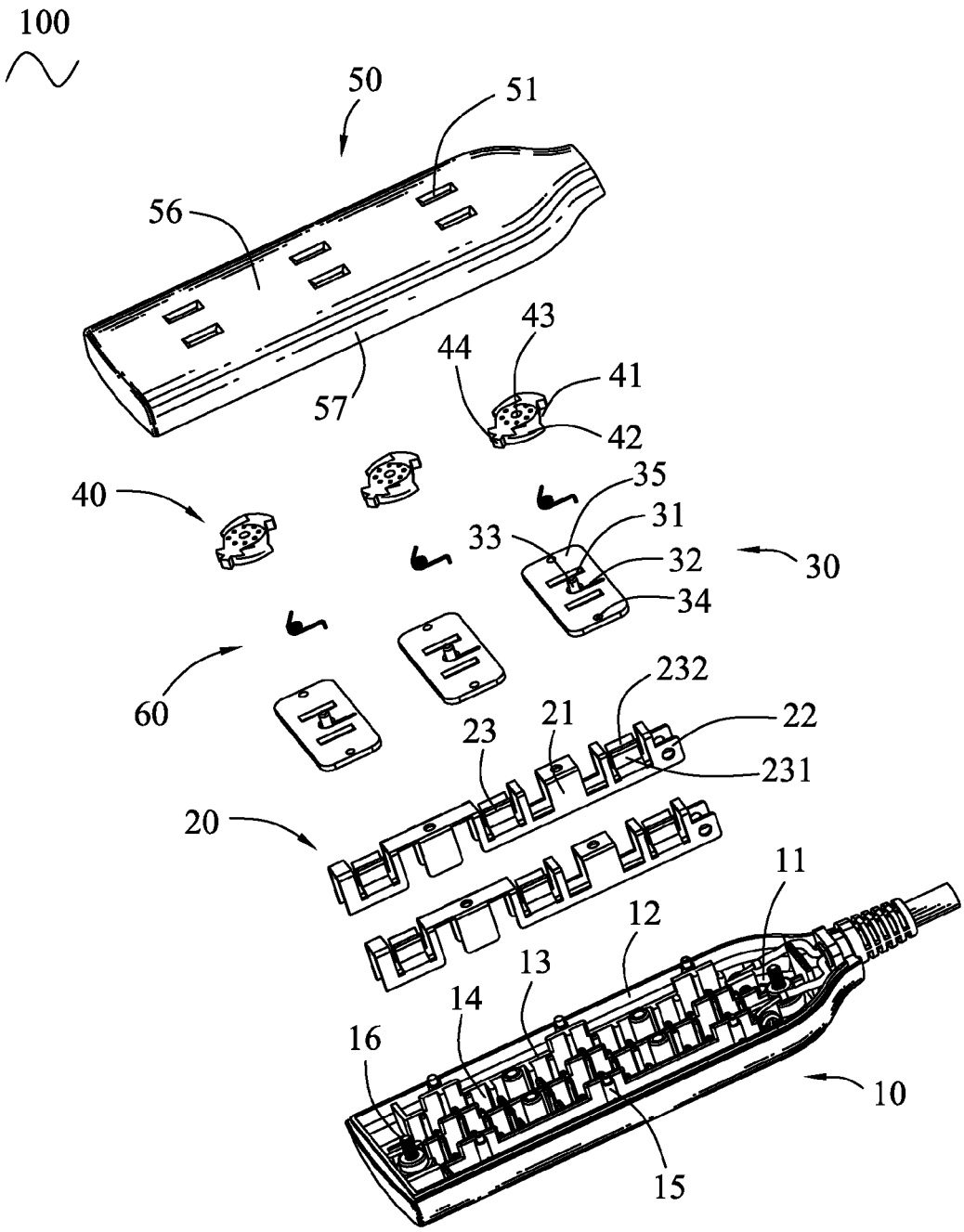
FIG. 4 is an exploded perspective view of the safety socket of FIG. 3.
Figure 5:
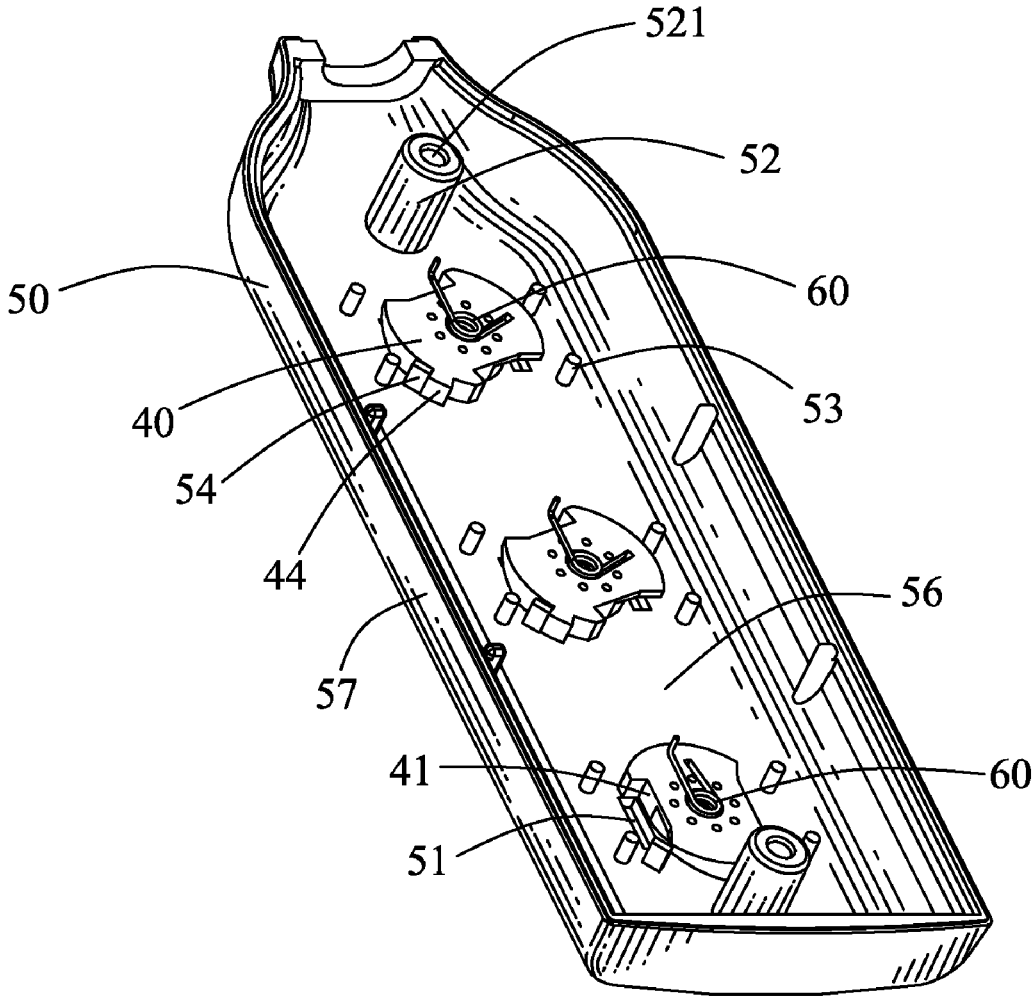
FIG. 5 shows a relationship between insulating baffles and a socket cover of the safety socket of FIG. 3, seen from a bottom view.

Referring to FIG. 4, a safety socket 100 according to an embodiment of the present invention includes a socket housing 10, at least two connection members 20, a plurality of holding pedestals 30, a plurality of insulating baffles 40, a plurality of torsional springs 60 and a socket cover 50 coupled with the socket housing 10.

The socket housing 10 has a basic board 11 and a skirt board 12 protruding upward from outer periphery of the basic board 11. A top surface of the basic board 11 protrudes upward to form at least two long separating walls 13 parallel to each other and apart from the skirt board 12. The number of the separating walls 13 is equal to that of the connection members 20. In this embodiment, there are two connection members 20 and two separating walls 13 respectively. Each of the separating walls 13 defines a receiving cavity 14 for receiving the corresponding connection member 20 therein. A plurality of positioning pillars 15 further protrude on the basic board 11 and are arranged at intervals into two rows located at two opposite sides of the separating walls 13. Each row of the positioning pillars 15 is parallel to the separating walls 13 and located between one of the separating walls 13 and the neighboring skirt board 12. Two ends of the top surface of the basic board 11 further protrude upward to form two fastening pillars 16 respectively for securing the socket cover 50.

Figure 6:
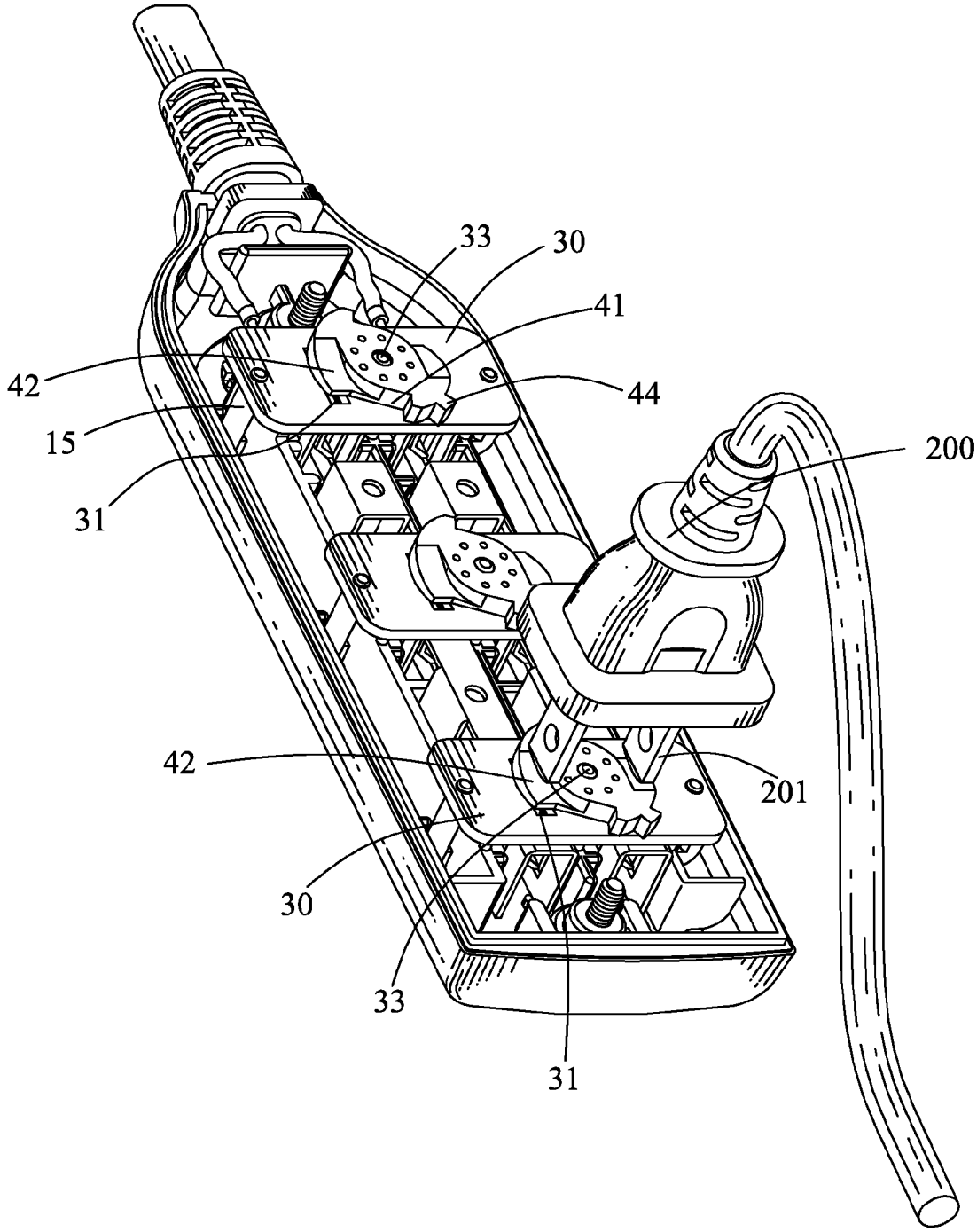
FIG. 6 is a schematic view illustrating a usage state of a plug being incompletely inserted into the safety socket of FIG. 3, wherein the socket cover is removed.
Figure 7:
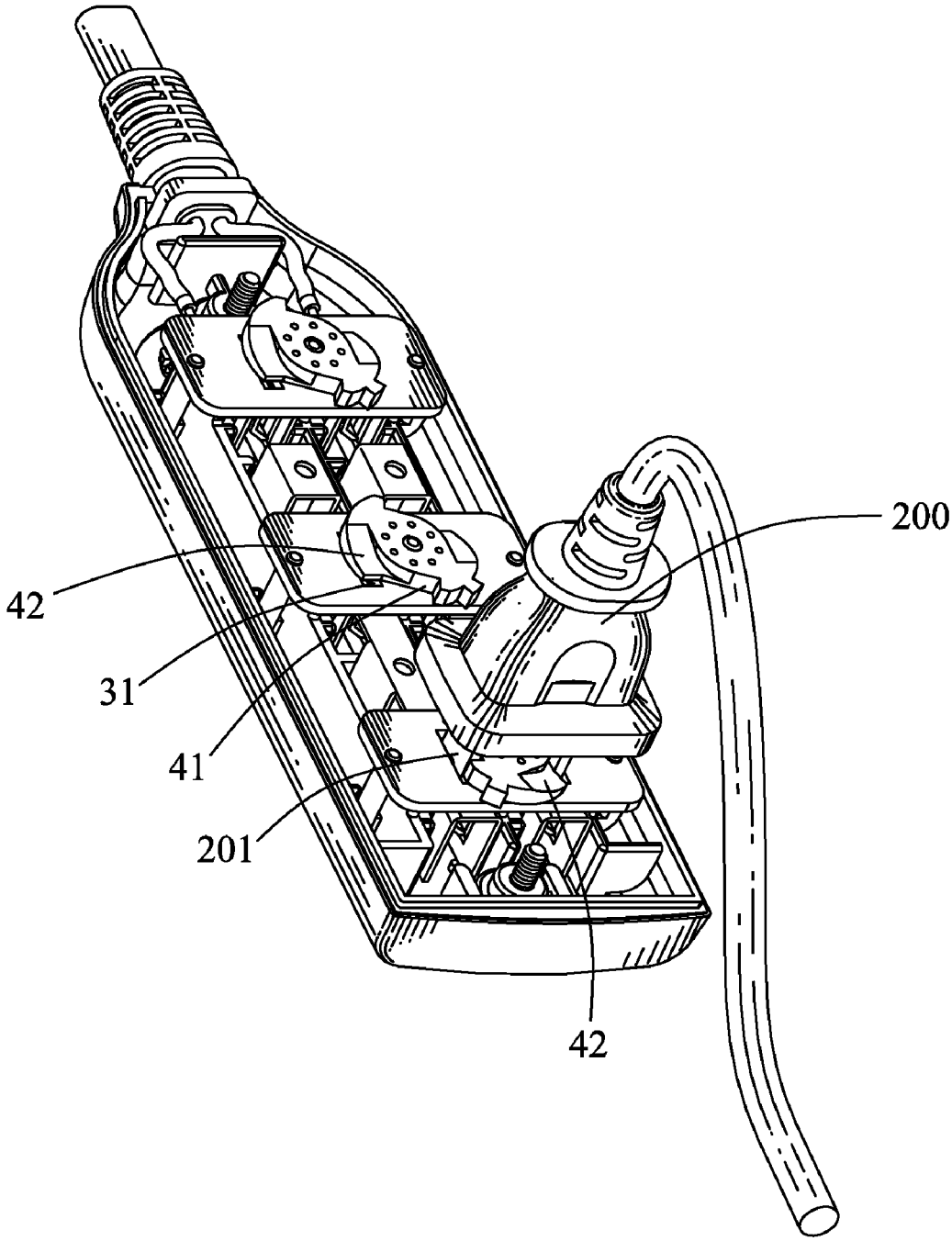
FIG. 7 is a schematic view illustrating a usage state of the plug being fully inserted in the safety socket of FIG. 3, wherein the socket cover is removed.

Referring to FIG. 4, FIG. 6 and FIG. 7, the connection member 20 has an elongated conductive portion 21, a locking portion 22 formed at one end of the conductive portion 21, and a plurality of electrodes 23 arranged at intervals along the length direction of the conductive portion 21. Each of the electrodes 23 is formed by a pair of clipping slices 231 protruding upward from the conductive portion 21 and facing to each other with an inserting mouth 232 formed between tops of the pair of clipping slices 231. The pair of clipping slices 231 further has substantial middles thereof arched towards each other. The connection members 20 are respectively disposed in the receiving cavities 14 of the socket housing 10 with the inserting mouth 232 exposed freely for facilitating a terminal 201 of a plug 200 to be inserted between the clipping slices 231. The locking portions 22 are secured with the corresponding separating walls 13.

Referring to FIG. 4, FIG. 6 and FIG. 7 again, the number of the holding pedestals 30 is equal to that of the electrodes 23 of each connection member 20. Each of the holding pedestals 30 has a substantially rectangular holding plate 35 straddled on corresponding two of the electrodes 23 of the connection members 20. A pair of inserting slots 31 is opened in the holding plate 35 and has an interval therebetween equal to that between the inserting mouths 232 of the corresponding two of the electrodes 23. So, the inserting slot 31 is located above the corresponding inserting mouth 232 for allowing the terminal 201 of the plug 200 to pass therethrough and insert into the electrode 23. The holding plate 35 further has a fixing groove 32 opened between the inserting slots 31, and a positioning post 33 protruded upward in the fixing groove 32 and formed at a substantial middle of the holding plate 35. Two opposite ends of the holding plate 35 define two positioning holes 34 for holding the corresponding positioning pillars 15 of the socket housing 10 therein, so as to make the holding pedestal 30 firmly fixed with respect to the electrodes 23 of the connection members 20.

Referring to FIGS. 4-7, the number of the insulating baffles 40 is equal to that of the electrodes 23 of the connection member 20. Each of the insulating baffles 40 is of substantially disc shape, and has two gaps 41 opened at a peripheral edge thereof and arranged at intervals along a circle of which a center is at the center of the insulating baffle 40. The insulating baffle 40 further defines two driven slopes 42 arranged alternately with the gaps 41 along the circle. Each driven slope 42 is gradually inclined upward from one end adjacent to the corresponding gap 41 to the other end thereof away from the corresponding gap 41. A pivot hole 43 is opened in the center of the insulating baffle 40, and a preventing block 44 protrudes outward at an outer peripheral of the insulating baffle 40. The insulating baffle 40 is pivoted above the holding pedestal 30 by means of the positioning post 33 being inserted in the pivot hole 43. The socket cover 50 has a covering board 56 and a lateral board 57 perpendicularly bent downward from a peripheral edge of the covering board 56. The covering board 56 defines two rows of inserting apertures 51 of which each has the number equal to that of the electrodes 23 of the connection member 20. Two ends of an inside of the covering board 56 protrude downward to form a pair of fastening portions 52, each having a fastening aperture 521 therein. The inside of the covering board 56 further protrudes downward to form a plurality of restraining posts 53 located around the inserting apertures 51. A preventing projection 54 is further provided beside each corresponding two inserting apertures 51.

The socket cover 50 is engaged with the socket housing 10 by means of the fastening pillars 16 fixed in the fastening apertures 521 of the fastening portions 52 respectively. The restraining posts 53 abut on the holding plates 35 of the holding pedestals 30 to further hold the holding pedestals 30 firmly. The insulating baffle 40 is restrained between the socket cover 50 and the holding pedestal 30. Each of the inserting apertures 51 is aligned with the corresponding inserting slot 31 of the holding pedestal 30 and the inserting mouth 232 of the corresponding electrode 23 along the insertion direction of the terminal 201 of the plug 200. The torsional spring 60 is sleeved to the positioning post 33 and located between the insulating baffle 40 and the holding pedestal 30, with one end being fastened in the fixing groove 32 and the other end being disposed under the insulating baffle 40, so as to make the driven slopes 42 of the insulating baffle 40 movably block between the inserting apertures 51 and the corresponding inserting slots 31. At this moment, the preventing block 44 is against the preventing projection 54 under the restoring force of the torsional spring 60.

Referring to FIGS. 3-7, when the plug 200 is inserted into the safety socket 100, the terminals 201 of the plug 200 are firstly inserted into the corresponding inserting apertures 51 of the socket cover 50 and against the driven slopes 42 of the insulating baffle 40. Then the plug 200 is further pressed downward to make the terminals 201 act on the driven slopes 42 so as to drive the insulating baffle 40 to rotate around the positioning post 33 of the holding pedestal 30. When the gap 41 of the insulating baffle 40 is aligned with the inserting slot 31 and the corresponding inserting mouth 232, the terminal 201 passes through the gap 41 and the inserting slot 31 to be inserted into the corresponding inserting mouth 232 and clipped between the clipping slices 231. So, an electrical connection is formed between the terminals 201 of the plug 200 and the corresponding electrodes 23 of the connection members 20, namely between the plug 200 and the safety socket 100. When the plug 200 is withdrawn out of the safety socket 100, the insulating baffle 40 rotates around the positioning post 33 under the drive of the restoring force of the torsional spring 60, until the preventing block 44 is resisted by the preventing projection 54. At this time, the driven slopes 42 newly block between the inserting apertures 51 and the corresponding inserting slots 31 for preventing accidental electric shock.

As described above, the insulating baffle 40 has the driven slopes 42 and the gaps 41 alternately arranged along the circle of which the center is located at the rotation axis of the insulating baffle 40. Such structure ensures the insertion force from the terminals 201 of the plug 200 acting on the driven slopes 42 be balanced about the rotation axis of the insulating baffle 40, so as to avoid the insulating baffle 40 slanting and even getting stuck in the process of the rotation thereof. Therefore, the safety socket 100 not only is convenient for users to operate, but also has a longer use life.

The foregoing description of the present invention has been presented for purposes of illustration and description. It is not intended to be exhaustive or to limit the invention to the precise form disclosed, and obviously many modifications and variations are possible in light of the above teaching. For example, the number of the connection members 20 could be three, and accordingly, the inserting slots 31 of the holding pedestal 30, the driven slopes 42 and the gaps 41 of the insulating baffle 40 are designed with three respectively. The gaps 41 are arranged at intervals along a circle, and the driven slopes 42 are arranged alternately with the gaps 41 along the circle, wherein the circle has the center located at the rotation axis of the insulating baffle 40. Such design makes the safety socket 100 capable of connecting with a three-phase plug (not shown). Such modifications and variations that may be apparent to those skilled in the art are intended to be included within the scope of this invention as defined by the accompanying claims.

What is claimed is:

1. A safety socket adapted for receiving a plug having at least two terminals, comprising:

a socket housing, at least two electrodes being mounted in the socket housing;

a socket cover coupled with the socket housing and defining at least two inserting apertures corresponding to the electrodes, each of the inserting apertures being aligned with the corresponding electrode along the insertion direction of the terminals of the plug; and an insulating baffle disposed between the socket housing and the socket cover and rotatably located above the electrodes by a torsional spring for operably blocking between the inserting apertures and the electrodes, the insulating baffle having at least two gaps opened at intervals along a circle of which a center is at the rotation axis of the insulating baffle, and at least two driven slopes arranged alternately with the gaps along the circle, each driven slope being gradually inclined upward from one end thereof adjacent to the corresponding gap to the other end thereof away from the corresponding gap;

wherein the driven slopes movably block between the inserting apertures and the corresponding electrodes, the terminals of the plug pass through the corresponding inserting apertures and act on the driven slopes to drive the insulating baffle to rotate so as to make the gaps exposed in alignment with the corresponding electrodes, then the terminals further pass through the gaps to be inserted in the corresponding electrodes.

2. The safety socket as claimed in claim 1, wherein a preventing block protrudes outward at a side of the insulating baffle, a preventing projection is further provided beside the inserting apertures for resisting the preventing block to stop the insulating baffle rotating, the insulating baffle rotates back under the restoring force of the torsional spring to make the driven slopes newly block between the inserting apertures and the electrodes after the plug is withdrawn out from the safety socket.

3. The safety socket as claimed in claim 1, further comprising a holding pedestal which has a holding plate mounted above the electrodes, at least two inserting slots being opened in the holding plate and each aligned with one of the electrodes and the corresponding inserting aperture for allowing the terminals of the plug to pass therethrough and insert into the electrodes, the insulating baffle being pivoted above the holding pedestal.

4. The safety socket as claimed in claim 3, wherein a substantial middle of the holding plate protrudes upward to form a positioning post located between the inserting slots, a pivot hole is opened in the rotation axis of the insulating baffle, the insulating baffle is pivoted above the holding pedestal by means of the positioning post being inserted in the pivot hole, the torsional spring is sleeved to the positioning post and located between the insulating baffle and the holding pedestal, with one end being fastened in the holding plate and the other end being disposed under the insulating baffle.

5. The safety socket as claimed in claim 3, wherein at least two positioning pillars are protruded in the socket housing and located around the electrodes, two ends of the holding plate define positioning holes, the holding pedestal is mounted above the electrodes by means of the positioning pillars inserted in the corresponding positioning holes to prop the holding plate.

6. The safety socket as claimed in claim 5, wherein the socket cover further defines a plurality of restraining posts protruded downward around the inserting apertures and abutting on the holding plate of the holding pedestal to further hold the holding pedestal.

7. The safety socket as claimed in claim 1, wherein the socket housing has at least two separating walls for holding a connection member respectively, the connection member has a conductive portion and at least one of the electrodes, the electrode is formed by a pair of clipping slices protruding upward from the conductive portion and facing to each other with an inserting mouth formed between tops of the pair of clipping slices, the pair of clipping slices further has substantial middles thereof arched towards each other, the conductive portion is respectively secured in the separating walls with the inserting mouth exposed freely for facilitating the terminals of the plug to be inserted between the clipping slices.

8. The safety socket as claimed in claim 1, wherein two fastening pillars further protrude upward at two ends of an inside of the socket housing, two ends of an inside of the socket cover protrude downward to form a pair of fastening portions, each having a fastening aperture for fixing the fastening pillars therein respectively.

* * * * *